US009562277B2

(12) United States Patent
Nakata et al.

(10) Patent No.: US 9,562,277 B2
(45) Date of Patent: Feb. 7, 2017

(54) MAGNESIUM ALLOY MATERIAL AND PRODUCTION PROCESS THEREOF

(75) Inventors: Mamoru Nakata, Inabe (JP); Yuuichi Yamada, Yokohama (JP); Koji Itakura, Yokohama (JP); Yoshio Okada, Yokohama (JP); Yoshihito Kawamura, Kumamoto (JP); Michiaki Yamasaki, Kumamoto (JP)

(73) Assignees: Kobe Steel, Ltd., Kobe-shi (JP); NISSAN MOTOR CO., LTD., Yokohama-shi (JP); NATIONAL UNIVERSITY CORPORATION KUMAMOTO UNIVERSITY, Kumamoto-shi (JP)

( * ) Notice: Subject to any disclaimer, the term of this patent is extended or adjusted under 35 U.S.C. 154(b) by 1526 days.

(21) Appl. No.: 11/943,207

(22) Filed: Nov. 20, 2007

(65) Prior Publication Data

US 2008/0152532 A1 Jun. 26, 2008

(30) Foreign Application Priority Data

Nov. 21, 2006 (JP) ..... 2006-314908

(51) Int. Cl.
*C22C 23/04* (2006.01)
*C22C 23/06* (2006.01)
*C22F 1/06* (2006.01)

(52) U.S. Cl.
CPC ..... *C22C 23/06* (2013.01); *C22C 23/04* (2013.01); *C22F 1/06* (2013.01)

(58) Field of Classification Search
CPC ..... C22C 23/04; C22C 23/06; C22F 1/06
USPC ..... 420/411
See application file for complete search history.

(56) References Cited

U.S. PATENT DOCUMENTS

| | | | |
|---|---|---|---|
| 2007/0102072 | A1 | 5/2007 | Kawamura et al. |
| 2007/0125464 | A1 | 6/2007 | Kawamura et al. |
| 2007/0169859 | A1 | 7/2007 | Kawamura et al. |

FOREIGN PATENT DOCUMENTS

| | | | |
|---|---|---|---|
| EP | 1 640 466 | A1 | 3/2006 |
| EP | 1 688 509 | A1 | 8/2006 |
| EP | 1 816 224 | A1 | 8/2007 |
| JP | 06-041701 | | 2/1994 |

(Continued)

OTHER PUBLICATIONS

U.S. Appl. No. 12/517,134, filed Jun. 1, 2009, Nakata, et al.

(Continued)

*Primary Examiner* — Jie Yang
(74) *Attorney, Agent, or Firm* — Oblon, McClelland, Maier & Neustadt, L.L.P.

(57) ABSTRACT

The present invention provides a magnesium alloy material, having superior mechanical properties without using special production equipment or processes, and a production process thereof. The magnesium alloy material of the present invention composed of an Mg—Zn—RE alloy comprises essential components in the form of 0.5 to 3 atomic percent of Zn and 1 to 5 atomic percent of RE, with the remainder comprising Mg and unavoidable impurities. The Mg—Zn—RE alloy has a lamellar phase formed from a long period stacking ordered structure and α-Mg in the alloy structure thereof. The long period stacking ordered structure has at least one of a curved portion and a bent portion and has a divided portion in at least a portion thereof. Finely granulated α-Mg having a mean particle diameter of 2 μm or less is formed in the divided portion.

12 Claims, 5 Drawing Sheets

(56) References Cited

FOREIGN PATENT DOCUMENTS

| | | |
|---|---|---|
| JP | 2002-256370 | 9/2002 |
| JP | 2005-113235 | 4/2005 |
| JP | 2006-097037 | 4/2006 |
| WO | WO 2005/052203 A1 | 6/2005 |
| WO | WO 2005/052204 A1 | 6/2005 |
| WO | WO 2006/036033 A1 | 4/2006 |

OTHER PUBLICATIONS

U.S. Appl. No. 12/293,489, filed Nov. 4, 2008, Nakata, et al.
Michiaki Yamasaki, et al., "Novel Mg—Zn—Gd Alloys in Which a Long Period Stacking Ordered Structure is Formed by High Temperature Heat Treatment", Summary of Presentations at the 108$^{th}$ Spring Conference (2005) of the Japan Institute of Light Metals, 2005, pp. 43 and 44 (with partial English Translation).
U.S. Appl. No. 12/678,516, filed Mar. 17, 2010, Nakata, et al.
Japanese Office Action issued Jun. 7, 2011, in Patent Application No. 2007-297953 (with English-language translation).
Hirokazu Tamagawa, et al., "Effect of plasticity processing on microstructure of Mg—Zn—Y alloy with a long period stacking ordered structure", Abstracts of Meeting of the Japan Institute of Metals, Sep. 16, 2006, the 139$^{th}$, p. 476 (with English Abstract).

LPO KINKING (CURVATURE, BENDING)
LPO DIVISION
PRECIPITATION OF FINE α-Mg IN DIVIDED PORTION OF LPO

MAGNESIUM ALLOY MATERIAL AND PRODUCTION PROCESS THEREOF

BACKGROUND OF THE INVENTION

1. Field of the Invention

The present invention relates to a magnesium alloy material and a production process thereof, and more particularly, to a magnesium alloy material having high mechanical strength and a production process thereof.

2. Description of the Related Art

In general, since magnesium alloy materials have the lowest density and lightest weight among practically used alloys while also having high strength, they are being increasingly used in applications such as chassis of electrical products as well as automobile wheels, underbody parts and around-the-engine parts.

Since parts used in automobile-related applications are particularly required to have high mechanical properties, materials of specific shapes are produced by a single roll process or rapid solidification process using magnesium alloy materials to which elements such as Gd or Zn have been added (see, for example, Japanese Patent Application Laid-open No. H06-041701, Japanese Patent Application Laid-open No. 2002-256370, and Michiaki Yamasaki and three others. "Novel Mg—Zn—Gd Alloys in which a long period stacking ordered Structure is Formed by High-Temperature Heat Treatment", Summary of Presentations at the 108th Spring Conference (2005) of the Japan Institute of Light Metals, Japan Institute of Light Metals, 2005, p. 43-44).

However, although the above-mentioned magnesium alloy materials allow the obtaining of high mechanical properties in specific production processes, these production processes have a disadvantage of requiring special equipment and having low productivity, while also having a problem of the existence of limitations on those members that can be used practically.

Therefore, processes have been proposed that allow the obtaining of magnesium alloy materials having practically useful mechanical properties even if plastic forming (extrusion) is carried out from ordinary dissolving and casting having high productivity without using special equipment or processes as indicated in the above-mentioned publications in the case of producing magnesium alloy materials (see, for example, International Publication Nos. WO 2005/052204, WO 2005/052203 and WO 2006/036033 and Japanese Patent Application Laid-open No. 2006-97037). The magnesium alloy materials disclosed in these publications have a long period stacking ordered structure within their structure and are known to allow the obtaining of high mechanical properties.

SUMMARY OF THE INVENTION

However, conventional magnesium alloy materials still have room for improvement as indicated below.

Namely, conventional magnesium alloy materials have been required to further improve strength in order to proceed with applications in automobiles for the purpose of reducing weight.

With the foregoing in view, an object of the present invention is to provide a magnesium alloy material having superior mechanical properties without using special production equipment or processes, and a production process thereof.

In order to solve the above-mentioned problems, the present invention was composed as a magnesium alloy material in the manner described below. Namely, the magnesium alloy material is a magnesium alloy material composed of an Mg—Zn—RE alloy comprising essential components in the form of Zn within the range of 0.5 to 3 atomic percent and RE within the range of 1 to 5 atomic percent, with the remainder comprising Mg and unavoidable impurities; wherein, the alloy structure of the Mg—Zn—RE alloy has a lamellar phase formed from a long period stacking ordered structure and α-Mg, and at least a portion of the long period stacking ordered structure has at least one of a curved portion and a bent portion and the long period stacking ordered structure has a divided portion.

In this manner, mechanical properties (tensile strength, 0.2% yield strength and elongation) of the magnesium alloy material can be improved as a result of composing the magnesium alloy material from an Mg—Zn—RE alloy, having a lamellar layer formed from a long period stacking ordered structure and α-Mg in the alloy structure thereof, having at least one of a curved portion and a bent portion in at least a portion of the long period stacking ordered structure, and having a divided portion in the long period stacking ordered structure. Furthermore, since twin deformation of magnesium alloy crystals is prevented by the formation of a long period stacking ordered structure, the mechanical properties of the magnesium alloy material are improved. In addition, the long period stacking ordered structure is formed on the C-axis bottom surface of magnesium alloy crystals. Thus, the C-axis bottom surface becomes curved or bent as a result of making the long period stacking ordered structure curved or bent. Since such curvature or bending of the C-axis bottom surface makes it extremely difficult for dislocations to migrate during deformation, deformation of magnesium alloy crystals is prevented and mechanical properties of the magnesium alloy material are improved.

The magnesium alloy material has a construction that finely granulated α-Mg having a mean particle diameter of 2 μm or less is formed in at least part of the alloy structure of the Mg—Zn—RE alloy.

In this manner, the mechanical properties of the magnesium alloy material can be further improved as a result of having finely granulated α-Mg having a mean particle diameter of 2 μm or less formed in at least part (e.g., in the divided portion of the long period stacking ordered structure) of the alloy structure of the Mg—Zn—RE alloy.

In addition, the magnesium alloy material is such that the above-mentioned RE comprises at least one type of Y, Dy, Ho, Er and Tm.

In this manner, as a result of using specific elements for the RE that composes the Mg—Zn—RE alloy, the tensile strength, 0.2% yield strength and elongation of the magnesium alloy material can be further improved.

In addition, the magnesium alloy material is such that the above-mentioned RE comprises at least one type of Gd and Tb.

In this manner, as a result of using specific elements for the RE that composes the Mg—Zn—RE alloy, the tensile strength, 0.2% yield strength and elongation of the magnesium alloy material can be further improved.

In addition, the production process of the magnesium alloy material comprises a dissolving/casting process, by which a cast material is obtained by dissolving and casting an Mg—Zn—RE alloy comprising essential components in the form of Zn within the range of 0.5 to 3 atomic percent and RE in the form of at least one type of Y, Dy, Ho, Er and Tm within the range of 1 to 5 atomic percent, with the remainder comprising Mg and unavoidable impurities, and a plastic forming process, by which hot plastic forming is carried out on the cast material to produce a processed material having a portion of equivalent strain of 1.5 or more in at least a portion thereof.

As a result of producing the magnesium alloy material by such a process, a lamellar phase formed from a long period stacking ordered structure and α-Mg is formed within the alloy structure of the Mg—Zn—RE alloy during casting, and by applying a predetermined amount of strain at a high temperature to this lamellar phase, the lamellar phase is finely granulated, at least one of a curved portion and a bent portion is formed and a divided portion is formed in at least a portion of the long period stacking ordered structure. Also, finely granulated α-Mg is formed in at least part of the alloy structure of the Mg—Zn—RE alloy (for example, in the divided portion of the long period stacking ordered structure). As a result, a magnesium alloy material is obtained having superior tensile strength, yield strength and elongation.

In addition, the production process of the magnesium alloy material comprises a dissolving/casting process, by which a cast material is obtained by dissolving and casting an Mg—Zn—RE alloy comprising essential components in the form of Zn within the range of 0.5 to 3 atomic percent and RE in the form of at least one type of Gd and Tb within the range of 1 to 5 atomic percent, with the remainder comprising Mg and unavoidable impurities, a heat treatment process, by which the cast material is heat treated at 480 to 550° C., and a plastic forming process, by which hot plastic forming is carried out on the heat treated cast material to produce a processed material having a portion of equivalent strain of 1.5 or more in at least a portion thereof.

As a result of producing the magnesium alloy material by such a process, a lamellar phase formed from a long period stacking ordered structure and α-Mg is formed within the alloy structure of the Mg—Zn—RE alloy during casting, and by applying a predetermined amount of strain at a high temperature to this lamellar phase, the lamellar phase is finely granulated, at least on of a curved portion and a bent portion is formed and a divided portion is formed in at least a portion of the long period stacking ordered structure. Also, finely granulated α-Mg is formed in at least part of the alloy structure of the Mg—Zn—RE alloy (for example, in the divided portion of the long period stacking ordered structure). As a result, a magnesium alloy material is obtained having superior tensile strength, yield strength and elongation.

Moreover, the plastic forming process of the process for producing a magnesium alloy material is in the form of an extruding process or a forging process.

As a result of producing the magnesium alloy material by such a process, the long period stacking ordered structure is promoted to form at least one of a curved portion and a bent portion and form a divided portion. Also, fine granulation of α-Mg is promoted in at least part of the alloy structure of the Mg—Zn—RE alloy (for example, in the divided portion of the long period stacking ordered structure). As a result, a magnesium alloy material is obtained having superior tensile strength, yield strength and elongation.

As a result of the magnesium alloy material as claimed in the present invention having a lamellar phase formed from a long period stacking ordered structure and α-Mg in the alloy structure of an Mg—Zn—RE alloy, at least one of a curved portion and a bent portion being formed and a divided portion being formed in at least a portion of the long period stacking ordered structure, tensile strength, yield strength and elongation (mechanical properties) can be improved as compared with alloy materials having a conventional long period stacking ordered structure. Also, as a result of the finely granulated α-Mg being formed in at least part of the alloy structure of the Mg—Zn—RE alloy (for example, in the divided portion of the long period stacking ordered structure), tensile strength, yield strength and elongation can be further improved.

Consequently, the magnesium alloy material as claimed in the present invention can be used in, for example, automobile parts, and particularly parts such as pistons subjected to strict conditions on mechanical properties.

In addition, the process for producing a magnesium alloy material of the present invention allows a magnesium alloy material having improved mechanical properties as compared with conventional magnesium alloy materials to be efficiently produced using ordinary production equipment or processes.

DETAILED DESCRIPTION OF THE PREFERRED EMBODIMENTS

Preferred embodiments for carrying out the present invention will be explained with reference to the drawings.

Figure 1:
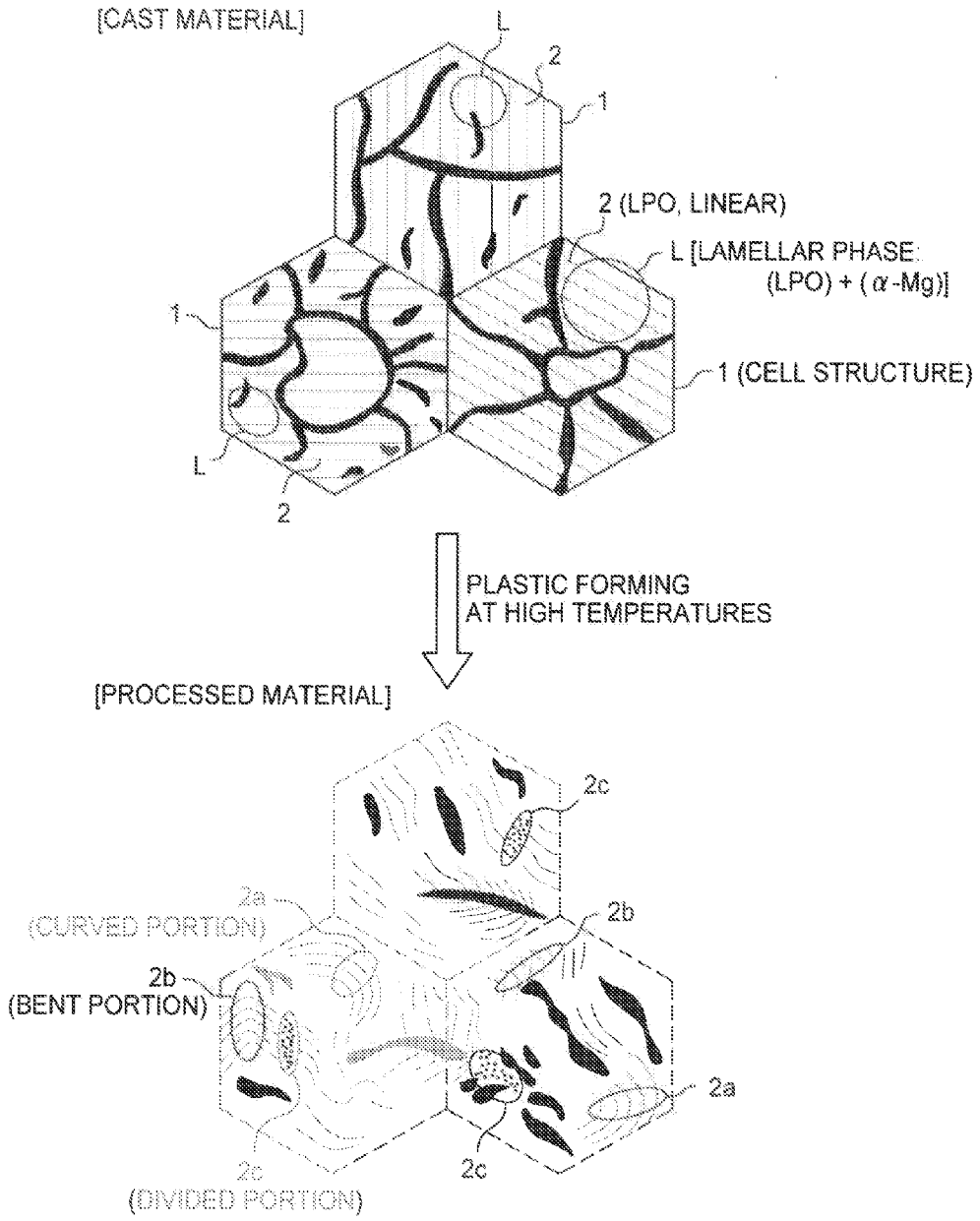
FIG. 1 is an explanatory drawing for providing a schematic explanation of the alloy structure of the magnesium alloy material according to the present invention.
Figure 2:
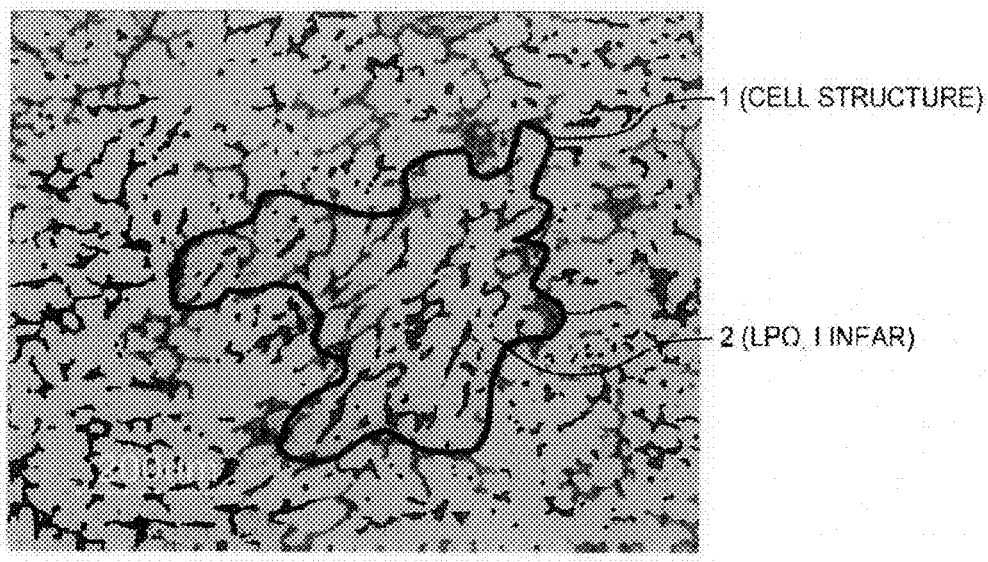
FIG. 2 is a light micrograph showing the alloy structure of a cast material in the magnesium alloy material according to the present invention.
Figure 3:
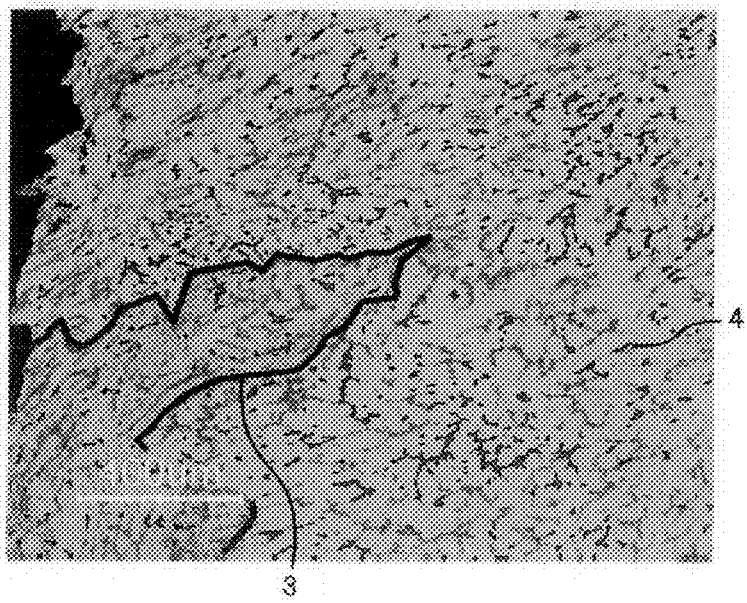
FIG. 3 is a light micrograph showing the processed structure (alloy structure) of the magnesium alloy material (processed material) according to the present invention.
Figure 4:
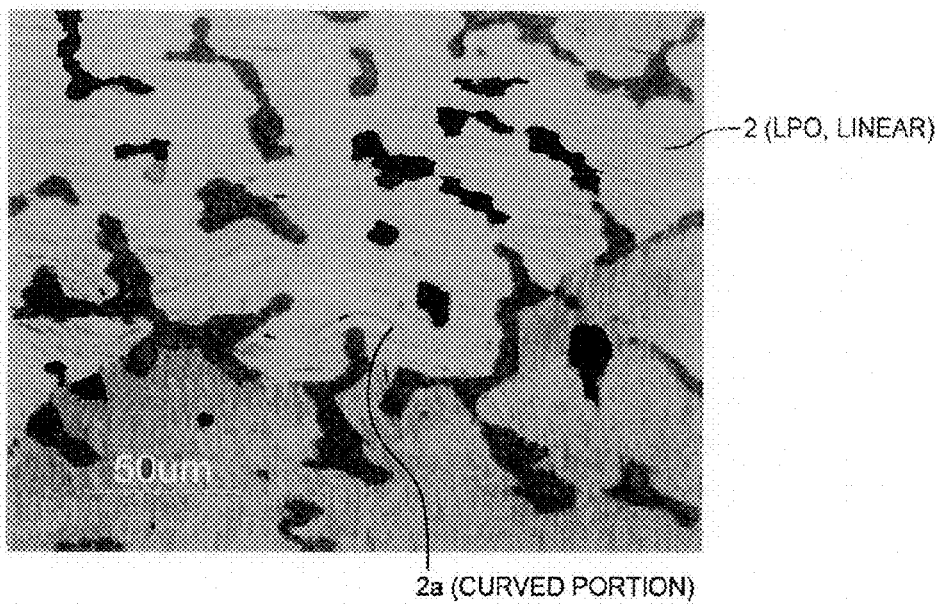
FIG. 4 is a light micrograph showing the alloy structure of the magnesium alloy material (processed material) according to the present invention.
Figure 5:
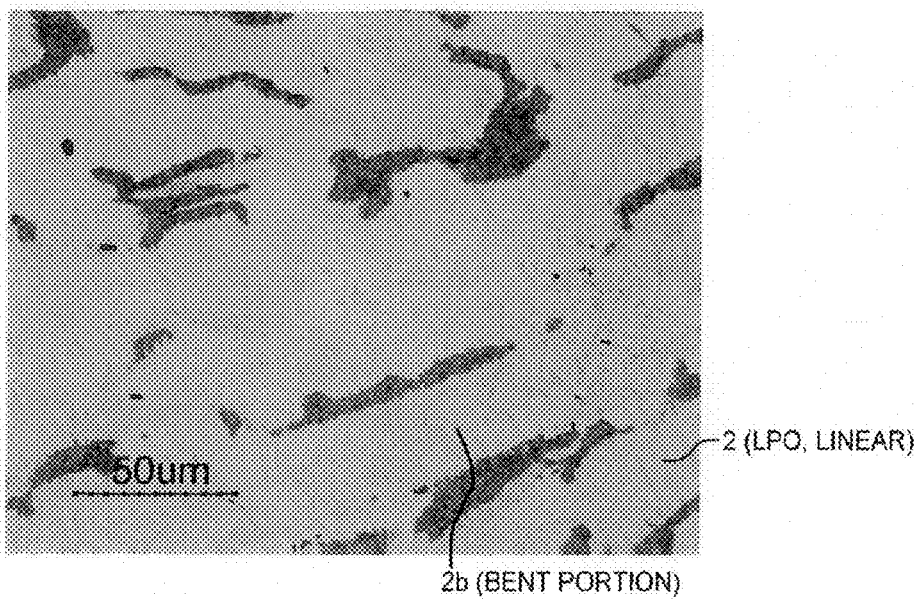
FIG. 5 is a light micrograph showing the alloy structure of the magnesium alloy material (processed material) according to the present invention.
Figure 6:
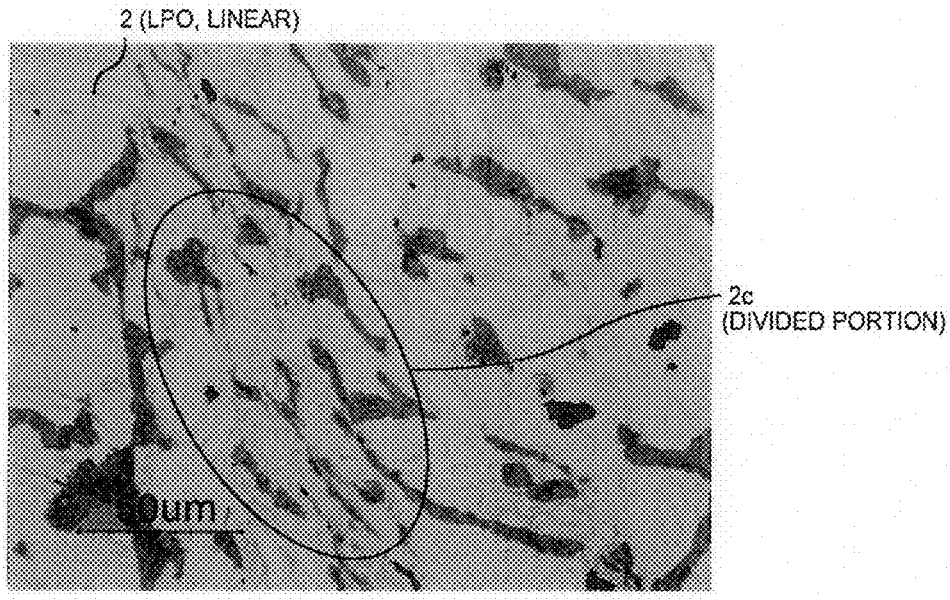
FIG. 6 is a light micrograph showing the alloy structure of the magnesium alloy material (processed material) according to the present invention.
Figure 7:
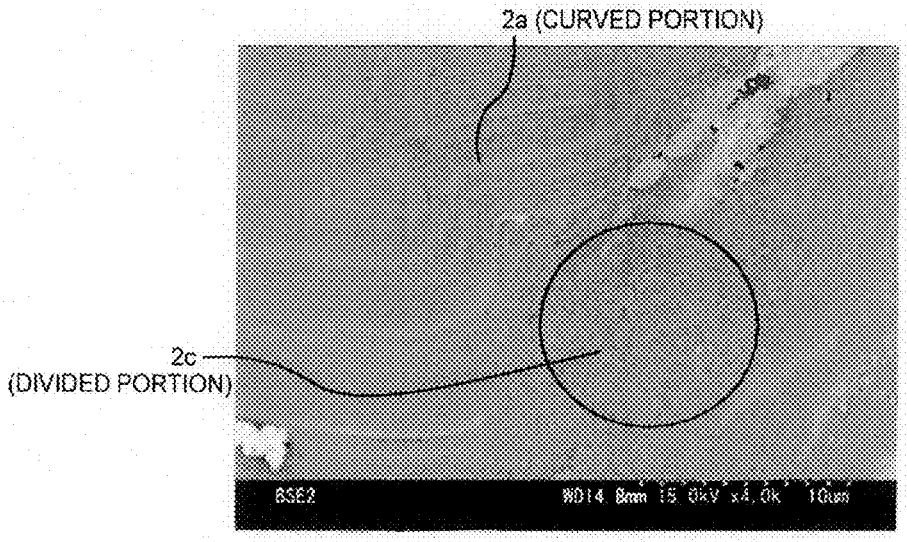
FIG. 7 is an SEM micrograph showing an enlarged view of a portion of the divided portion of FIG. 6.
Figure 8:
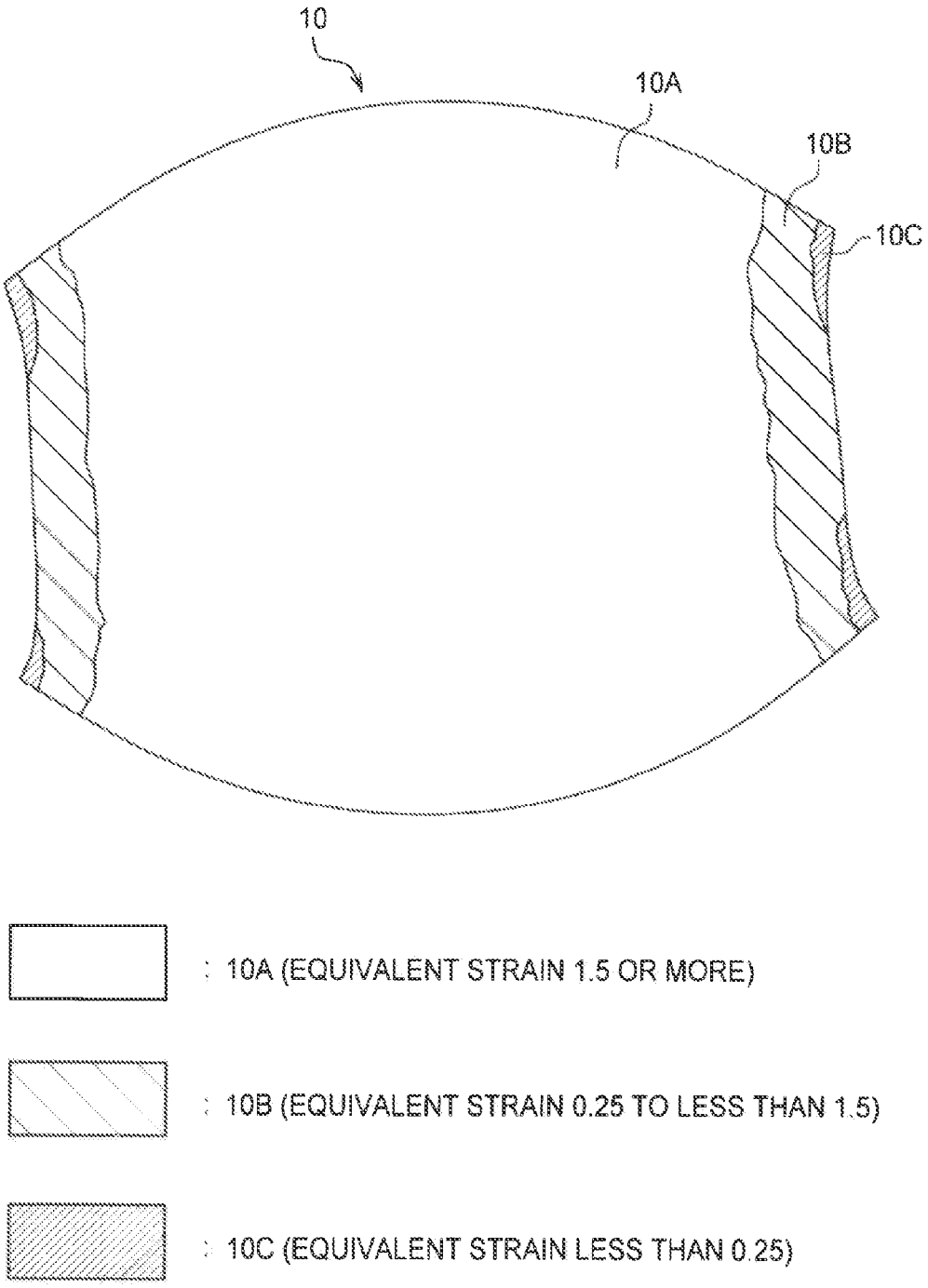
FIG. 8 is a longitudinal cross-sectional view showing the distribution of equivalent strain of the magnesium alloy material (processed material) as claimed in the present invention.

FIG. 1 is an explanatory drawing that provides a schematic explanation of the alloy structure of the magnesium alloy material according to the present invention, FIG. 2 is a light micrograph showing the alloy structure of a cast material, FIG. 3 is a light micrograph showing the processed structure (alloy structure) of a processed material, FIGS. 4 to 6 are light micrographs showing the alloy structures of processed materials, FIG. 7 is an SEM micrograph showing an enlarged view of a divided portion of FIG. 6, and FIG. 8 is a longitudinal cross-sectional view showing the distribution of equivalent strain of a processed material.

The magnesium alloy material is used in parts used in high-temperature environments such as automobile parts and particularly pistons, valves, lifters, tappets and sprockets and the like for internal combustion engines. Furthermore, examples of the shape of the magnesium alloy material include plates and rods, and the shape is suitably selected according to the shape of the part in which it is used.

The magnesium alloy material is composed of an Mg—Zn—RE alloy comprising essential components in the form of Zn within the range of 0.5 to 3 atomic percent and RE within the range of 1 to 5 atomic percent, with the remainder comprising Mg and unavoidable impurities. The following provides a detailed explanation of each component.

[Alloy Components]

(Zn)

The Mg—Zn—RE alloy contains Zn as an essential component within the range of 0.5 to 3 atomic percent. If the amount of Zn is less than 0.5 atomic percent, it is not possible to obtain an Mg-RE intermetallic compound (such as $Mg_3Gd$), and the tensile strength and 0.2% yield strength of the magnesium alloy material decrease. In addition, if the amount of Zn exceeds 3 atomic percent, since the form of the long period stacking ordered structure of the lamellar phase is such that a curved portion or bent portion is not formed, and remains linear (continuous form) without forming a divided portion. Also, the α-Mg in at least part of the alloy structure of the Mg—Zn—RE alloy is not finely granulated (fine α-Mg is not formed). Consequently, improvements in tensile strength and 0.2% yield strength corresponding to the amount of magnesium alloy material added are not obtained and elongation decreases (namely, embrittlement occurs).

(RE: Rare Earth)

The Mg—Zn—RE alloy contains RE as an essential component within the range of 1 to 5 atomic percent. As a result of adding a specific amount of RE together with Zn, a long period stacking ordered structure is formed in the alloy structure of the Mg—Zn—RE alloy, and a lamellar phase formed from this long period stacking ordered structure and α-Mg can be formed. Here, if the amount of RE is less than 1 atomic percent, an Mg-RE intermetallic compound (such as $Mg_3Gd$) cannot be obtained, and tensile strength and 0.2% yield strength of the magnesium alloy material decrease. In addition, if the amount of RE exceeds 5 atomic percent, since the form of the long period stacking ordered structure of the lamellar phase is such that a curved portion or bent portion is not formed, and remains linear (continuous form) without forming a divided portion. Also, the α-Mg in at least part of the alloy structure of the Mg—Zn—RE alloy is not finely granulated. Consequently, improvements in tensile strength and 0.2% yield strength corresponding to the amount of magnesium alloy material added are not obtained and elongation decreases (namely, embrittlement occurs). RE here refers to a type 1 RE comprising at least one type of Y, Dy, Ho, Er and Tm or a type 2 RE comprising at least one type of Gd and Tb. Furthermore, since Y in type 1 RE causes problems in terms of dissolving and recycling, RE is preferably at least one type of Dy, Ho and Er.

(Unavoidable Impurities)

Furthermore, other components can be added to the Mg—Zn—RE alloy other the components described above within the range of unavoidable impurities. For example, Zr contributing to fine granulation may be contained within the range of 2 atomic percent or less. If within the above-mentioned range, the other components do not have an effect on the effects of the magnesium alloy material as claimed in the present invention. In addition, Fe, Ni, Cu, Si and the like may also be respectively contained at 0.2 percent by weight or less.

As shown in FIG. 1, the Mg—Zn—RE alloy has a lamellar phase L formed from a long period stacking ordered (LPSO) structure 2 and α-Mg within the alloy structure thereof, and together with at least a portion of the long period stacking ordered structure 2 having at least one of a curved portion 2*a* and bent portion 2*b* and having a divided portion 2*c*. Also, finely granulated α-Mg having a mean particle diameter of 2 μm or less is formed in at least part of the alloy structure of the Mg—Zn—RE alloy (for example, in the divided portion 2*c* of the long period stacking ordered structure 2).

[α-Mg]

As shown in FIG. 1, α-Mg forms a lamellar phase L with the long period stacking ordered structure 2 to be described later within the cell structure (mean particle diameter of 50 μm or more) of the Mg—Zn—RE alloy in the dissolving/casting process (cast material). In the plastic forming process carried out in a high-temperature atmosphere (while heating), it is preferable that α-Mg is finely granulated (fine α-Mg precipitates) to a mean particle diameter of 2 μm or less in at least part of the alloy structure of the Mg—Zn—RE alloy (in divided portion 2*c* of long period stacking ordered structure 2). Here, if the mean particle diameter of the finely granulated α-Mg in a divided portion exceeds 2 μm, the mechanical properties, and particularly elongation, of the magnesium alloy material do not improve.

[Long Period Stacking Ordered Structure]

As shown in FIGS. 1 and 2, long period stacking ordered structure 2 forms lamellar structure particles in the form of lamellar phase L with α-Mg within the alloy structure, or in other words, within cell structure 1, of a cast material (Mg—Zn—RE alloy) in the dissolving/casting process or in a heat treatment process following the dissolving/casting process. long period stacking ordered structure 2 is formed in a linear shape, is formed in the same direction within the same cell structure 1, and formed in mutually different directions among cell structures 1. In FIG. 1, long period stacking ordered structure 2 is indicated with narrow lines, while wide lines represent the state in which long period stacking ordered structure 2 is aggregated to a high density.

Long period stacking ordered structure 2 refers to a structure in which an a plurality of ordered lattices are arranged, a plurality of ordered lattices are again arranged by means of a shift of an anti-phase, unit structures are formed that are several times to ten or more times the original lattice, and the period thereof is long. Long period stacking ordered structures appear within a slight temperature range between the ordered phase and disordered phase, the reflection of the ordered phase is split in electron diffraction patterns, and diffraction spots appear at locations corresponding to periods several times to ten or more times longer.

In the state in which this long period stacking ordered structure is formed alone, the mechanical properties of the magnesium alloy material are inadequate in that high elongation is unable to be obtained even though a high tensile strength and 0.2% yield strength are maintained. Consequently, as shown in FIG. 1, at least one of a curved portion 2*a* and a bent portion 2*b* is formed and a divided portion 2*c*, in which the arrangement of ordered lattices is disrupted, is formed in at least a portion of the long period stacking ordered (LPSO) structure 2 of the formed long period stacking ordered (LPSO) structures 2, 2, . . . Furthermore, the formation of curved portion 2*a*, bent portion 2*b* and divided portion 2*c* in this long period stacking ordered (LPSO) structure 2 is achieved by carrying out a plastic forming process in which a cast material or heat-treated cast material is subjected to hot plastic forming. As previously described, precipitation of fine α-Mg finely granulated to a mean particle diameter of 2 μm or less in at least part of the alloy structure of the Mg—Zn—RE alloy (for example, in divided portion 2*c* of long period stacking ordered structure 2) is achieved by carrying out the plastic forming process. In addition, cell structure 1 formed during casting disappears as a result of hot plastic forming (the disappearance of cell structure 1 is indicated with dotted lines in the processed material of FIG. 1).

Furthermore, long period stacking ordered structure 2 having a curved portion 2*a*, bent portion 2*b* and divided portion 2*c* (and containing α-Mg formed in divided portion 2*c*) is preferably 10% or more of the long period stacking ordered structures 2 formed in the processed material, or in other words, all of the long period stacking ordered structures 2 formed during casting (including heat treatment following casting). As shown in FIG. 3, long period stacking ordered structure 2 having a curved portion 2*a*, bent portion 2*b* and divided portion 2*c* (and containing α-Mg formed in divided portion 2*c*) is observed in the form of a highly processed structure 3 (within the thick lines) having a high degree of processing in light micrographs (magnification: 50×) of the processed material. Portions other than highly processed structure 3 are observed in the form of lowly processed structure 4 having a low degree of processing and in a form that approximates a cast structure.

In the present invention, curved portion 2*a*, bent portion 2*b* and divided portion 2*c* refer to portions observed in the states indicated below during observation of the alloy structure of a processed material with a light microscope (magnification of 100× or more and preferably 400 to 500×). Namely, as shown in FIG. 4, a portion in which long period stacking ordered structure 2 is observed to be curved and not linear is referred to as curved section 2*a*. As shown in FIG. 5, a portion in which long period stacking ordered structure 2 is observed to be bent and not linear is referred to as bent section 2*b*. As shown in FIGS. 6 and 7, a portion in which an intermediate portion of a linear, curved or bent long period stacking ordered structure 2 is observed to be divided is referred to as divided section 2*c*. Furthermore, although not observed in FIGS. 6 and 7, finely granulated α-Mg having a mean particle diameter of 2 μm or less precipitates in at least part of the alloy structure of the Mg—Zn—RE alloy (for example, in divided portion 2*c*).

Next, a process for producing the magnesium alloy material according to the present invention will be explained.

The process for producing the magnesium alloy material differs according to the type of Mg—Zn—RE alloy that composes the magnesium alloy material. Namely, there are two production processes used for the case of using a type 1 Mg—Zn—RE alloy in which RE comprises at least one type of Y, Dy, Ho, Er and Tm (first production process), and the case of using a type 2 Mg—Zn—RE alloy in which RE comprises at least one type of Gd and Tb (second production process).

[First Production Process]

The first production process comprises a dissolving/casting process and a plastic forming process. The following provides an explanation of each process.

(Dissolving/Casting Process)

Mg—Zn—RE alloy (Type 1) containing 0.5 to 3 atomic percent of Zn and 1 to 5 atomic percent of RE in the form of at least one type of Y, Dy, Ho, Er and Tm, with the remainder comprising Mg and unavoidable impurities, is dissolved and cast to obtain a cast material. In this cast material composed of type 1 Mg—Zn—RE alloy, the Mg—Zn—RE alloy adopts the form of a cell structure, and within this cell structure 1, a lamellar phase L is formed from long period stacking ordered structure 2 and α-Mg (see FIGS. 1 and 2). Furthermore, dissolving and casting are carried out in accordance with ordinary methods. In addition, dissolving is preferably in the form of flux refining in order to remove oxides from the molten metal.

(Plastic Forming Process)

Hot plastic forming is carried out on the cast material produced in the above-mentioned process. Hot plastic forming requires that adequate strain be applied necessary for finely granulating lamellar phase L produced by casting as well as forming at least one of curved portion 2*a* and bent portion 2*b* and forming divided portion 2*c* in at least a portion of long period stacking ordered structure 2. Also, it is preferable that adequate strain be applied necessary for forming finely granulated α-Mg in at least part of the alloy structure of the Mg—Zn—RE alloy (for example, in divided portion 2*c* of the long period stacking ordered structure 2). Furthermore, cell structure 1 formed during casting disappears as a result of this hot plastic forming (see FIG. 1). Consequently, as shown in FIG. 8, processed material 10 produced by hot plastic forming comes to have a portion 10A in which an equivalent strain of 1.5 or more in at least a portion thereof. When using this processed material in an automobile part and the like, the portion requiring high mechanical properties is made to be composed with portion 10A having an equivalent strain of 1.5 or more. Thus, hot plastic forming is preferably carried out so that all portions of processed material 10 have an equivalent strain of 1.5 or more, thus preventing the formation of portions 10B and 10C having an equivalent strain of less than 1.5. In addition, in the divided portion 2*c*, fine α-Mg occurs at a width of divided portion 2*c* of 1 μm or more.

Equivalent strain refers to the equivalent strain corresponding to Von Mieses yield stress, and is calculated according to formula (1) below. Furthermore, in the following formula (1), equivalent strain is represented by $\epsilon$, true strain in the direction of length by $\epsilon_1$, true strain in the direction of width by $\epsilon_2$, and true strain in the direction of thickness by $\epsilon_3$.

[Formula 1]

$$\varepsilon = \sqrt{\frac{2}{3}(\varepsilon_1^2 + \varepsilon_2^2 + \varepsilon_3^2)} \tag{1}$$

Here, if the imparted strain (equivalent strain) is less than 1.5, it becomes difficult to form a curved portion, bent portion and divided portion in the long period stacking ordered structure.

Also, α-Mg in the alloy structure of the Mg—Zn—RE alloy (for example, α-Mg in divided portion 2*c*) becomes difficult to be finely granulated to a mean particle diameter of 2 μm or less. Consequently, in addition to the tensile strength and yield strength of the magnesium alloy material decreasing, elongation also ends up having a low value. Furthermore, although there are no particular limitations on the upper limit of equivalent strain, since the tensile strength, 0.2% yield strength and elongation of the magnesium alloy material decrease if the applied equivalent strain is excessively high, it is preferably less than 2.3, and more preferably within the range of 1.5 to 2.0.

In addition, the processing temperature when carrying out hot plastic forming can be suitably selected corresponding to the processability of the cast material within a range of 300 to 500° C.

When an extruding process is used for hot plastic forming, carrying out extrusion at an extrusion temperature of 300 to 500° C. and an extrusion ratio within the range of 5 to 9.9, and preferably 6 to 9, allows the obtaining of a magnesium alloy material having favorable mechanical properties.

When a forging process is used for hot plastic forming, carrying out forging under the condition represented by the following formula (2) is preferable since fine crystal grains can be obtained while preventing cracking of the forged material.

[Formula 2]

$$T \geq 2X + 210 \quad (2)$$

Furthermore, in formula (2), T(°C.) represents the temperature at completion of forging, while X(%) represents the working ratio.

In the case of applying equivalent strain to a processed material in a forging process, the temperature at completion of forging and the working ratio become suitable and there is no occurrence of cracking during the forging process by carrying out forging so as to satisfy predetermined conditions. In other words, in the case of the temperature at completion of forging (T) not reaching a temperature having the value calculated by adding 210 to twice the working ratio (X), cracking tends to occur easily during forging, thereby making this unsuitable. In addition, in the case the temperature at completion of forging (T) is excessively high, fine crystal subgrains formed by plastic forming grow by dynamic recrystallization and cause a decrease in the mechanical properties of the magnesium alloy material. Thus, the upper limit of the temperature at completion of forging (T) is preferably the temperature having the value calculated by adding 310 to twice the working ratio (X).

[Second Production Process]

The second production process comprises a dissolving/casting process, a heat treatment process and a plastic forming process. The following provides an explanation of each process.

(Dissolving/Casting Process)

The dissolving/casting process is the same as in the first production process with the exception of using an Mg—Zn—RE alloy (type 2) containing 0.5 to 3 atomic percent of Zn and 1 to 5 atomic percent of RE in the form of at least one type of Gd and Tb, with the remainder comprising Mg and unavoidable impurities.

(Heat Treatment Process)

The cast material produced in the above-mentioned process is subjected to heat treatment at 480 to 550° C. to control the formation of the long period stacking ordered structure. If the temperature conditions of heat treatment are less than 480° C. or less than 1 hour, a long period stacking ordered structure is not adequately formed in the cast material. In addition, if the temperature exceeds 550° C., problems occur such as local melting of the cast material. Furthermore, heat treatment is carried out according to ordinary methods using known heat treatment equipment. Moreover, although varying according to the size of the cast material, the duration of heat treatment is preferably 1 hour or more for a cast material measuring 29 mm in outer diameter and 75 mm in length, or 24 hours or more for a cast material measuring 100 mm in outer diameter and 180 mm in length. Furthermore, α-Mg having a mean particle diameter of 10 to 20 μm may be formed following heat treatment.

(Plastic Forming Process)

Hot plastic forming is carried out on the cast material heat treated in the above-mentioned process in the same manner as the first production process to produce a processed material having at least a portion thereof having an equivalent strain of 1.5 or more.

A stabilization treatment process in which the magnesium alloy material (processed material) is held at a temperature of 200 to 300° C. for 10 hours or more may be added to the process for producing a magnesium alloy material as claimed in the present invention after carrying out the plastic forming process in the first or second production process for the purpose of stabilizing the dimensions of the magnesium alloy material (processed material). In the case of having used a type 2 Mg—Zn—RE alloy in particular, adding the above-mentioned stabilization treatment process improves dimensional stability, which is favorable in terms of enabling the magnesium alloy material to be applied to products used while being subjected to the effects of heat, such as pistons, valves, lifters, tappets and sprockets for internal combustion engines.

In addition, when a forging process is used for the plastic forming process, a cutting process may be carried out for cutting a processed material to a predetermined shape such as that of a piston, valve, lifter, tappet or sprocket for an internal combustion engine as necessary following the stabilization treatment process for stabilizing dimensions as described above.

EXAMPLES

Examples of the present invention will be explained hereinafter.

Examples 1 to 12

Mg—Zn—RE alloys having the compositions shown in Table 1 were placed in a melting furnace and dissolved by flux refining. Continuing, the heated and dissolved molten metal was cast in a metal mold to produce an ingot having an outer diameter of 29 mm and length of 60 mm. This ingot was subjected to an extruding process while changing the extrusion ratio so that the equivalent strain at an extrusion temperature of 375° C. was 0.7 to 2.2 to produce the magnesium alloy materials of Examples 1 to 12.

After polishing the surfaces of the resulting magnesium alloy materials of Examples 1 to 12 with #120 to #1000 sandpaper, the surfaces were mirrored by buffing with alumina and the like, after which the mirrored surfaces were etched with aqueous glycol acetate to prepare surfaces for observation of structure. These surfaces for observation of structure were observed with a light microscope at a magnification of 400× to observe the state of the long period stacking ordered (LPSO) structure. In addition, the surfaces for observation of structure were observed by TEM (magnification: 4000×) to confirm the presence or absence of fine α-Mg having a mean particle diameter of 2 μm or less. In addition, JIS standard test pieces were cut out of the resulting magnesium alloy materials of Examples 1 to 12, and tensile tests were conducted at ordinary temperatures to measure tensile strength, 0.2% yield strength and elongation. Those results are shown in Table 1. Furthermore, tensile strength and 0.2% yield strength were evaluated as being high for values of 270 MPa or more or low for values of less than 270 MPa. In addition, elongation was evaluated as being high for values of 3% or more or low for values of less than 3%.

Comparative Examples 1 to 5

Magnesium alloy materials of Comparative Examples 1 to 5 were produced in the same manner as Examples 1 to 8 with the exception making the Zn and RE contents of the Mg—

Zn—RE alloy outside the scope of claims of the present invention in Comparative Examples 1 and 2, and making the equivalent strain in the extrusion process outside the scope of claims of the present invention in Comparative Examples 3 to 5. The state of the long period stacking ordered (LPSO) structure and the presence or absence of fine α-Mg having a mean particle diameter of 2 μm or less were confirmed, and tensile strength, 0.2% yield strength and elongation were measured for the magnesium alloy materials of Comparative Examples 1 to 5 in the same manner as Examples 1 to 8. Those results are shown in Table 1.

TABLE 1

| | Zn (at %) | RE (at %) | Equivalent strain | LPSO state | Fine α-Mg | Tensile strength (MPa) | 0.2% Yield strength (MPa) | Elongation (%) |
|---|---|---|---|---|---|---|---|---|
| Ex. 1 | 1 | Y: 2 | 1.6 | Division + kinking | ○ | 390 | 350 | 3.2 |
| Ex. 2 | 1 | Y: 2 | 2.0 | Division + kinking | ○ | 376 | 314 | 7.1 |
| Ex. 3 | 1 | Y: 2 | 2.2 | Division + kinking | ○ | 352 | 300 | 7.0 |
| Ex. 4 | 1 | Y: 1 | 1.7 | Division + kinking | ○ | 370 | 333 | 3.5 |
| Ex. 5 | 2 | Y: 3 | 1.7 | Division + kinking | ○ | 430 | 387 | 10 |
| Ex. 6 | 1 | Dy: 2 | 1.7 | Division + kinking | ○ | 350 | 315 | 4.0 |
| Ex. 7 | 1 | Ho: 2 | 1.7 | Division + kinking | ○ | 340 | 306 | 5.0 |
| Ex. 8 | 1 | Er: 2 | 1.7 | Division + kinking | ○ | 345 | 310 | 4.5 |
| Ex. 9 | 1 | Y: 2 | 1.6 | Division + kinking | ○ | 385 | 348 | 3.0 |
| Ex. 10 | 1 | Y: 2 | 1.6 | Division + kinking | X | 330 | 310 | 5.0 |
| Ex. 11 | 1 | Tm: 1 | 1.7 | Division + kinking | ○ | 347 | 308 | 4.3 |
| Ex. 12 | 1 | Tm: 2 | 1.7 | Division + kinking | ○ | 340 | 306 | 7.3 |
| Comp. Ex. 1 | 0.2 | Y: 0.6 | 1.6 | Division + kinking | ○ | 260 | 201 | 6.5 |
| Comp. Ex. 2 | 4 | Y: 7 | 1.5 | Linear (continuous) | X | 448 | 367 | 0.6 |
| Comp. Ex. 3 | 1 | Y: 2 | 0.7 | Kinking | X | 238 | Unable to be measured | 0 |
| Comp. Ex. 4 | 1 | Y: 2 | 1.0 | Kinking | X | 242 | Unable to be measured | 0 |
| Comp. Ex. 5 | 1 | Y: 2 | 1.4 | Kinking | X | 352 | Unable to be measured | 0 |

Note:
Kinking: Presence of curved portions or bent portions
Note:
Fine α-Mg(mean particle diameter: 2 μm or less)
○: Contained
X: Not contained As shown in Table 1, the magnesium alloy materials of Examples 1 to 12 that satisfy the scope of claim for patent of the present invention demonstrated superior tensile strength, 0.2% yield strength and elongation, and have high levels of strength and ductility required by materials such as piston parts. Fine α-Mg in Examples 1 to 8, 11, 12 were formed between the divided lamellar phase and the adjacent lamellar phase (the divided portion of the long period stacking ordered structure). Fine α-Mg in Example 9 was formed in the alloy structure other than parts between divided lamellar phase and the adjacent lamellar phase in the Mg—Zn—RE alloy.

On the other hand, since the magnesium alloy material of Comparative Example 1 has Zn and Y contents less than the lower limits, although it had a certain degree of elongation, tensile strength and 0.2% yield strength even if equivalent strain of 1.6 is applied. Since the magnesium alloy material of Comparative Example 2 has Zn and Y contents that exceed the upper limits, although tensile strength and 0.2% yield strength were high, elongation was extremely low at 0.6%, thereby lacking ductility. Although the Zn and Y contents of the magnesium alloy materials of Comparative Examples 3 to 5 were within the scope of claim for patent of the present invention, since equivalent strain was lower than 1.5, they demonstrated hardly any elongation. In addition, Comparative Examples 3 and 4 also demonstrated low tensile strength.

Examples 13 to 20

Mg—Zn—RE alloys having the compositions shown in Table 2 were placed in a melting furnace and dissolved by flux refining. Continuing, the heated and dissolved molten metal was cast in a metal mold to produce an ingot having an outer diameter of 29 mm and length of 60 mm. This ingot was subjected to heat treatment for 2 hours at 510° C. followed by upset forging at a forging temperature of 350° C. while varying the upset ratio so that the equivalent strain from the direction orthogonal to the cylinder was 0.7 to 2.2 to produce the magnesium alloy materials of Examples 13 to 20.

The metal structures of the resulting magnesium alloy materials of Examples 13 to 20 were observed by light microscopy and TEM to confirm the state of the long period stacking ordered (LPSO) structure and the presence or absence of fine α-Mg having a mean particle diameter of 2 μm or less. In addition, JIS standard test pieces were cut out of the resulting magnesium alloy materials of Examples 13 to 20, and tensile tests were conducted at ordinary temperatures to measure tensile strength, 0.2% yield strength and elongation. Those results are shown in Table 2.

Comparative Examples 6 to 10

Magnesium alloy materials of Comparative Examples 6 to 10 were produced in the same manner as Examples 9 to 15 with the exception making the Zn and RE contents of the Mg—Zn—RE alloy outside the scope of claims of the present invention in Comparative Examples 6 and 7, and making the equivalent strain during upset forging outside the scope of claims of the present invention in Comparative Examples 8 to 10. The state of the long period stacking ordered (LPSO) structure and the presence or absence of fine α-Mg having a mean particle diameter of 2 μm or less were confirmed, and tensile strength, 0.2% yield strength and elongation were measured for the magnesium alloy materials of Comparative Examples 6 to 10 in the same manner as Examples 9 to 15. Those results are shown in Table 2.

Comparative Example 11

The magnesium alloy material of Comparative Example 11 was produced in the same manner as Comparative Example 10 with the exception of not carrying out heat treatment and upset forging on the ingot (thus resulting in an equivalent strain of 0) and using the ingot as a magnesium alloy material. The state of the long period stacking ordered (LPSO) structure and the presence or absence of fine α-Mg having a mean particle diameter of 2 μm or less were confirmed, and tensile strength, 0.2% yield strength and elongation were measured for the magnesium alloy material of Comparative Example 11 in the same manner as Comparative Example 10. Those results are shown in Table 2.

TABLE 2

| | Zn (at %) | RE (at %) | Equivalent strain | LPSO state | Fine α-Mg | Tensile strength (MPa) | 0.2% Yield strength (MPa) | Elongation (%) |
|---|---|---|---|---|---|---|---|---|
| Ex. 13 | 1 | Gd: 2 | 1.6 | Division + kinking | ○ | 360 | 325 | 6.8 |
| Ex. 14 | 1 | Gd: 2 | 2.0 | Division + kinking | ○ | 380 | 342 | 6.0 |
| Ex. 15 | 1 | Gd: 2 | 2.2 | Division + kinking | ○ | 390 | 351 | 5.5 |
| Ex. 16 | 1 | Gd: 1 | 1.7 | Division + kinking | ○ | 310 | 279 | 10 |
| Ex. 17 | 2 | Gd: 3 | 1.7 | Division + kinking | ○ | 400 | 360 | 5.0 |
| Ex. 18 | 1 | Tb: 2 | 1.7 | Division + kinking | ○ | 350 | 315 | 7.0 |
| Ex. 19 | 1 | Gd: 2 | 1.6 | Division + kinking | ○ | 358 | 321 | 6.5 |
| Ex. 20 | 1 | Gd: 2 | 1.6 | Division + kinking | X | 300 | 280 | 10.0 |
| Comp. Ex. 6 | 0.2 | Gd: 0.6 | 1.6 | Division + kinking | ○ | 260 | 201 | 6.5 |
| Comp. Ex. 7 | 4 | Gd: 7 | 1.5 | Linear (continuous) | X | 450 | 405 | 0.6 |
| Comp. Ex. 8 | 1 | Gd: 2 | 0.7 | Kinking | X | 250 | Unable to be measured | 0 |
| Comp. Ex. 9 | 1 | Gd: 2 | 1.0 | Kinking | X | 255 | Unable to be measured | 0 |
| Comp. Ex. 10 | 1 | Gd: 2 | 1.4 | Kinking | X | 345 | Unable to be measured | 0 |
| Comp. Ex. 11 | 1 | Gd: 2 | 0 | Linear (continuous) | X | 180 | 150 | 2 |

Note:
Kinking: Presence of curved portions or bent portions
Note:
Fine α-Mg(mean particle diameter: 2 μm or less)
○: Contained
X: Not contained
Note:
Tensile strength, 0.2% yield strength and elongation of Comparative Example 11 were measured using an ingot.

As shown in Table 2, the magnesium alloy materials of Examples 9 to 15 that satisfy the scope of claim for patent of the present invention demonstrated superior tensile strength, 0.2% yield strength and elongation, and have high levels of strength and ductility required by materials such as piston parts. Fine α-Mg in Examples 13 to 18 were formed between the divided lamellar phase and the adjacent lamellar phase (the divided portion of the long period stacking ordered structure). Fine α-Mg in Example 19 was formed in the alloy structure other than parts between divided lamellar phase and the adjacent lamellar phase in the Mg—Zn—RE alloy.

On the other hand, since the magnesium alloy material of Comparative Example 6 has Zn and Gd contents less than the lower limits, although it had a certain degree of elongation, tensile strength and 0.2% yield strength even if equivalent strain of 1.6 is applied. Since the magnesium alloy material of Comparative Example 7 has Zn and Gd contents that exceed the upper limits, although tensile strength and 0.2% yield strength were high, elongation was extremely low at 0.6%, thereby lacking ductility. Although the Zn and Gd contents of the magnesium alloy materials of Comparative Examples 8 to 10 were within the scope of claim for patent of the present invention, since equivalent strain was lower than 1.5, they demonstrated hardly any elongation. In addition, Comparative Examples 8 and 9 also demonstrated low tensile strength. Since heat treatment and upset forging were not carried out for the magnesium alloy material of Comparative Example 11, tensile strength, 0.2% yield strength and elongation were low.

What is claimed is:

1. A magnesium alloy material composed of an Mg—Zn—RE alloy comprising essential components in the form of Zn within the range of 0.5 to 3 atomic percent and RE within the range of 1 to 5 atomic percent, with the remainder comprising Mg and unavoidable impurities, the RE being at least one element selected from the group consisting of Y, Dy, Ho, Er and Tm, wherein the magnesium alloy is produced by a process comprising preparing a cast material by dissolving and casting said Mg—Zn—RE alloy and producing a processed material by conducting a hot plastic forming process on the cast material without any heat treatment;

the alloy structure of the Mg—Zn—RE alloy has a lamellar phase formed from a long period stacking ordered structure and α-Mg, and at least a portion of the long period stacking ordered structure has at least one of a curved portion and a bent portion and has a divided portion.

2. The magnesium alloy material according to claim 1, wherein finely granulated α-Mg having a mean particle diameter of 2 μm or less is formed in at least part of the alloy structure of the Mg—Zn—RE alloy.

3. The magnesium alloy material according to claim 1, wherein RE is Y.

4. The magnesium alloy material according to claim 1, wherein RE is Dy.

5. The magnesium alloy material according to claim 1, wherein RE is Ho.

6. The magnesium alloy material according to claim 1, wherein RE is Er.

7. The magnesium alloy material according to claim 1, wherein RE is Tm.

8. The magnesium alloy material according to claim 1, wherein the processed material has a portion of equivalent strain of 1.5 or more in at least a portion thereof.

9. The magnesium alloy material according to claim 1, wherein said plastic forming process is an extruding process.

10. The magnesium alloy material according to claim 9, wherein said extruding process is at a temperature of 300 to 500° C. and an extrusion ratio ranging from 5 to 9.9.

11. The magnesium alloy material according to claim 1, wherein said plastic forming process is a forging process.

12. The magnesium alloy material according to claim 11, wherein said forging process satisfies the condition represented by formula (2):

$$T \geq 2X+210 \quad (2)$$

wherein T(°C.) is the temperature at the completion of forging and X(%) is the working ratio.

* * * * *